US012410594B2

(12) United States Patent
Deng

(10) Patent No.: US 12,410,594 B2
(45) Date of Patent: Sep. 9, 2025

(54) FAUCET STRUCTURE

(71) Applicant: Ziliang Deng, Jiangmen (CN)

(72) Inventor: Ziliang Deng, Jiangmen (CN)

( * ) Notice: Subject to any disclaimer, the term of this patent is extended or adjusted under 35 U.S.C. 154(b) by 107 days.

(21) Appl. No.: 18/542,623

(22) Filed: Dec. 16, 2023

(65) Prior Publication Data

US 2024/0125100 A1 Apr. 18, 2024

(30) Foreign Application Priority Data

Jan. 10, 2023 (CN) ..... 202320078614.6

(51) Int. Cl.
*E03C 1/04* (2006.01)

(52) U.S. Cl.
CPC ..... *E03C 1/0404* (2013.01); *E03C 1/0403* (2013.01); *E03C 2001/0414* (2013.01); *Y10T 137/9464* (2015.04)

(58) Field of Classification Search
CPC ..... E03C 1/04; E03C 1/0404; E03C 1/0405; E03C 1/0403; E03C 1/0408; E03C 1/0414; Y10T 137/9464
USPC ..... 137/801
See application file for complete search history.

(56) References Cited

U.S. PATENT DOCUMENTS 1,166,374 A * 12/1915 Jackson ..... B05B 1/16 239/548
6,442,775 B1 * 9/2002 Gransow ..... E03C 1/0408 4/615
11,505,926 B2 * 11/2022 Lee ..... E03C 1/023
2006/0196563 A1 * 9/2006 Liles ..... E03C 1/0404 137/616.7
2012/0097279 A1 4/2012 Ko et al.
2017/0211259 A1 7/2017 Lin
2018/0318886 A1 * 11/2018 Libbrecht ..... E03C 1/046
2021/0198874 A1 7/2021 Zhang et al.

FOREIGN PATENT DOCUMENTS

DE 10219943 B4 * 1/2005 ..... B05B 1/1627

OTHER PUBLICATIONS

DE 10219943B4 , Schmid, Machine Translation (Year: 2005).*

* cited by examiner

*Primary Examiner* — Daphne M Barry
(74) *Attorney, Agent, or Firm* — Hemisphere Law, PLLC; Zhigang Ma

(57) ABSTRACT

A faucet structure comprises a water outlet pipe with a control switch, one end of the water outlet pipe is fixedly connected to a water diversion seat, one end of the water diversion seat is rotatably connected to a water diversion connector. One side of the water diversion connector is provided with a first water outlet hole for connecting to a shower head assembly, the bottom end of the water diversion connector is provided with a second water outlet hole for connecting to a valve seat, the side of the valve seat is provided with a switch connection hole, and the bottom end of the valve seat is provided with a first water flowing hole and a second water flowing hole. A switch assembly for switching the water flow between the first water flowing hole and the second water flowing hole is arranged in the switch connection hole.

6 Claims, 4 Drawing Sheets

FAUCET STRUCTURE

CROSS-REFERENCE TO RELATED APPLICATION

This application claims the priority benefit of China application no. 202320078614.6 filed on Nov. 10, 2023. The entirety of the above-mentioned patent application is hereby incorporated by reference herein and made a part of this specification.

BACKGROUND

Technical Field

The disclosure relates to the technical field of faucets, and in particular relates to a novel water faucet structure.

Description of Related Art

Water faucet is used in places such as kitchens and bathrooms, and it is one of the indispensable water supply tools in people's lives. In normal use, water flows out from the water outlet of the faucet directly. With different usage scenarios, water outflow modes of the faucet also increase, such as adding faucet bubbler and shower head for water outflow.

However, when designing, another water outflow mode is usually realized by additionally adding water outflow pipelines, thereby forming a faucet with a structure of multiple water outflow pipelines.

Patent No. CN201921750754.3 discloses a multi-functional faucet with a rotatable water outlet. During in use, the cold water supplied from the municipal tap water outlet enters the cold water passage 44 from the cold water inlet 41 of the valve seat 4, and under the on-off control of the pure water valve core 9 inside the pure water handle 8, the cold water enters the filter element 5, the purified water from the filter element 5 flows out through the water-producing end of the filter element 5, filling the space enclosed by the filter element gland 22, the upper part of the mixed water sealing ring 222 and the lower part of the pure water sealing ring 223, flowing to the pure water passage 133 of the rotating shaft water separator 13, entering the pure water pipe 16 and finally flowing out from the second water outlet 12. On the other hand, the hot water supplied from the municipal tap water outlet enters the hot water passage 45 from the hot water inlet 42, and under the control of the tap water handle 7 and the tap water valve core 6, directly enters the mixed water channel 31 along with the cold water flowing in from the branch of the cold water passage 44, filling the space enclosed by the mixed water channel 31 and the lower part of the mixed water sealing ring 222, flowing to the mixed water channel 134 of the rotating shaft water separator 13, entering the mixed water pipe 17, and finally flowing out from the first water outlet 11.

Patent No. CN201320838086.6 discloses a water faucet with double water outlets, which includes two water outlets, namely a first water outlet 3 and a second water outlet 4. The first water outlet 3 is located in front of the water outlet body 2 and can furnish a water flow with an inclined angle; the second water outlet 4 is located on the bottom surface of the water outlet body 2 and can furnish a water flow vertically downward. When the switch 7 is switched to one end, the water flow in the faucet body 1 is connected to the first water outlet 3, and the water flow flows out from the first water outlet 3. When the switch 7 is switched to the other end, the water flow in the faucet body 1 is connected to the second water outlet 4, and the water flow flows out from the second water outlet 4. The rotating body 5 drives the water flowing body 6 to rotate around the faucet body 1. When the water flowing body 6 rotates to the position directly below the water outlet body 2, the water flow flowing out from the second water outlet 4 falls into the groove on the water flowing body 6, guided by the groove, the water flow flows off like a waterfall and flows into the pool. By rotating the water flowing body 6 and the water outlet body 2 simultaneously, the direction of the waterfall-like water flow can be adjusted. When the water flowing body 6 rotates to other positions, the water flow flowing out from the second water outlet 4 falls off vertically and flows into the pool. When in use, the switch is switched to one end as required, so that water flow flows out from the first water outlet 3 or the second water outlet 4. Then rotate the rotating body 5 and the water flowing body 6 as required to adjust the shape of the water flow from the second water outlet 4.

The faucets in the above-mentioned patents all adopt a double water outlet pipeline structure, which has a complex structure and many spare parts, which increases the production cost of the faucet; at the same time, when in use, water flow from different water outlets flows to different positions, movement of the user's use position according to the different positions of the different water outlets is required, which reduces the use effect of the faucet, and improvement is required.

SUMMARY

The objective of the disclosure is to overcome the above-mentioned defects or problems in the prior art by providing a new faucet structure with simple structure and convenient use.

To accomplish the foregoing objective, the following technical solutions are adopted by the disclosure:

A faucet structure comprises a water outlet pipe, and the water outlet pipe is provided with a control switch, an end of the water outlet pipe is fixedly connected to a water diversion seat, and an end of the water diversion seat is rotatably connected to a water diversion connector, a side of the water diversion connector is provided with a first water outlet hole and is connected to a shower head assembly through the first water outlet hole, a bottom end of the water diversion connector is provided with a second water outlet hole and is connected to the valve seat through the second water outlet hole, a side wall of the valve seat is provided with a switch connection hole, a bottom end of the valve seat is provided with a first water flowing hole and a second water flowing hole, a switch assembly for switching the water flow between the first water flowing hole and the second water flowing hole is provided in the switch connection hole; a central position of the water diversion seat is provided with an installation hole, and the installation hole is provided with a rotating shaft and is rotatably connected to a central position of the water diversion connector through the rotating shaft, a first water diversion hole and a second water diversion hole are eccentrically provided in the water diversion seat, and the first water diversion hole and the second water diversion hole are communicated with the water outlet pipe internally, a partition plate partitioning an interior of the water diversion connector into a first water outlet cavity and a second water outlet cavity is provided in the water diversion connector, a side of the first water outlet cavity close to the water diversion seat is provided with a first water passing hole, and a side wall of the first water outlet cavity is provided with the first water outlet hole, a side of the second water outlet cavity close to the water diversion seat is provided with the second water passing hole, an end wall of a bottom end of the second water outlet cavity is disposed with the second water outlet hole, when the water diversion connector is rotated and the second water outlet hole faces downward, the second water passing hole is aligned to the second water diversion hole, and the first water passing hole is staggered with the first water diversion hole, when the water diversion connector is rotated and the first water outlet hole faces downward, the first water passing hole is aligned to the first water diversion hole, and the second water passing hole is staggered with the second water diversion hole.

Further, an inner side of an end of the water outlet pipe close to the water diversion seat is embedded with a position-limiting sleeve and the position-limiting sleeve is threadedly connected with an end of the water diversion seat close to the water outlet pipe, and a flat gasket is provided between the water diversion seat and the water diversion connector and the flat gasket is clamped with and connected to the water diversion seat.

Further, the shower head assembly comprises a water outlet housing and a water outlet panel, the water outlet housing and the water outlet panel are fixedly connected to form a rectangular hollow shell structure, a middle part of the water outlet housing is provided with a through hole and is connected to the first water outlet hole through the through hole, the water outlet panel is provided with several shower spray holes.

Further, the switch assembly comprises a button, a valve stem, a water control member and a spring, an end of the spring urges against an inner wall of the valve seat and another end of the spring is connected with the water control member, the water control member is located in the valve seat and can slide above the first water flowing hole and the second water flowing hole along an axis direction of the switch connection hole, the valve stem is located in the switch connection hole, an end of the valve stem is connected to the water control member and another end of the valve stem passes through the switch connection hole and connects with the button.

Further, the bottom end of the valve seat is fixedly connected with a water outlet part, the water outlet part is provided with a first water outlet channel and a second water outlet channel, a top end of the water outlet part is embedded in and connected with the bottom end of the valve seat, and a top end of the first water outlet channel communicates with the first water flowing hole, a top end of the second water outlet channel communicates with the second water flowing hole, and the first water outlet channel is internally connected with a faucet bubbler.

Further, the faucet structure further comprises a protective shell, the protective shell is fixedly sleeved on the periphery of the water diversion connector, the shower head assembly, the switch assembly and the water outlet part, the protective shell is arranged in the shape of a rectangular column shell and an end of the protective shell is provided with a first connection port and the first connection port is sleeved on the periphery of the water diversion seat, and a wear-resistant ring is arranged between the first connection port and the water diversion seat, the wear-resistant ring is sleeved on the periphery of the water diversion seat, a side of the protective shell is provided with a second connection port and is connected to the water outlet panel through the second connection port, a bottom end of the protective shell is provided with a third connection port and is connected to the water outlet part through the third connection port, and another side of the protective shell is provided with an avoidance hole for avoiding the button.

Based on the above description of the disclosure, the disclosure exhibits the following beneficial effects compared to the related art.

When in use, the water flow firstly flows out of the water outlet pipe by operating the control switch, the water flow then will flow to the valve seat after passing through the water diversion seat and the second water outlet hole of the water diversion connector, and then under the control of the switch assembly, flows out from the first water flowing hole and the second water flowing hole. Since a faucet bubbler is disposed below the first water flowing hole, the water flow below the first water flowing hole flows out from the faucet bubbler, and the water flow below the second water flowing hole flows out directly; when the water flow needs to be discharged from the shower head, rotating the water diversion connector to make the shower head assembly faces downward, at the moment, the water flow from the water outlet pipe flows into the shower head assembly after flowing through the first water outlet hole, and finally flows out from the shower head; only one water outlet pipeline can realize three water outflow modes, that is flowing out directly, flowing out from the shower head and flowing out from the faucet bubbler, the structure is simpler and the production cost is reduced, meanwhile for the three water outflow modes, the water flow always flows out to the same position, therefore movement of the user's use position according to different water outflow modes is not needed, the use effect of the faucet thus improved effectively.

BRIEF DESCRIPTION OF THE DRAWINGS

To make the technical solutions provided in the embodiments of the disclosure more clearly illustrated, several accompanying drawings required by the embodiments for description are briefly introduced as follows. Obviously, the drawings in the following description are only some embodiments of the disclosure, and for a person having ordinary skill in the art, other drawings can be obtained based on these drawings without inventive effort.

DESCRIPTION OF THE EMBODIMENTS

The accompanying drawings in the embodiments of the disclosure are included to provide a clear and complete description of the technical solutions provided in the embodiments of the disclosure. Obviously, the described embodiments are preferred embodiments of the disclosure, and should not be regarded as exclusion of other embodiments. Based on the embodiments of the disclosure, all other embodiments obtained by a person of ordinary skill in the art without making any inventive effort fall within the scope that the disclosure seeks to protect.

Figure 1:
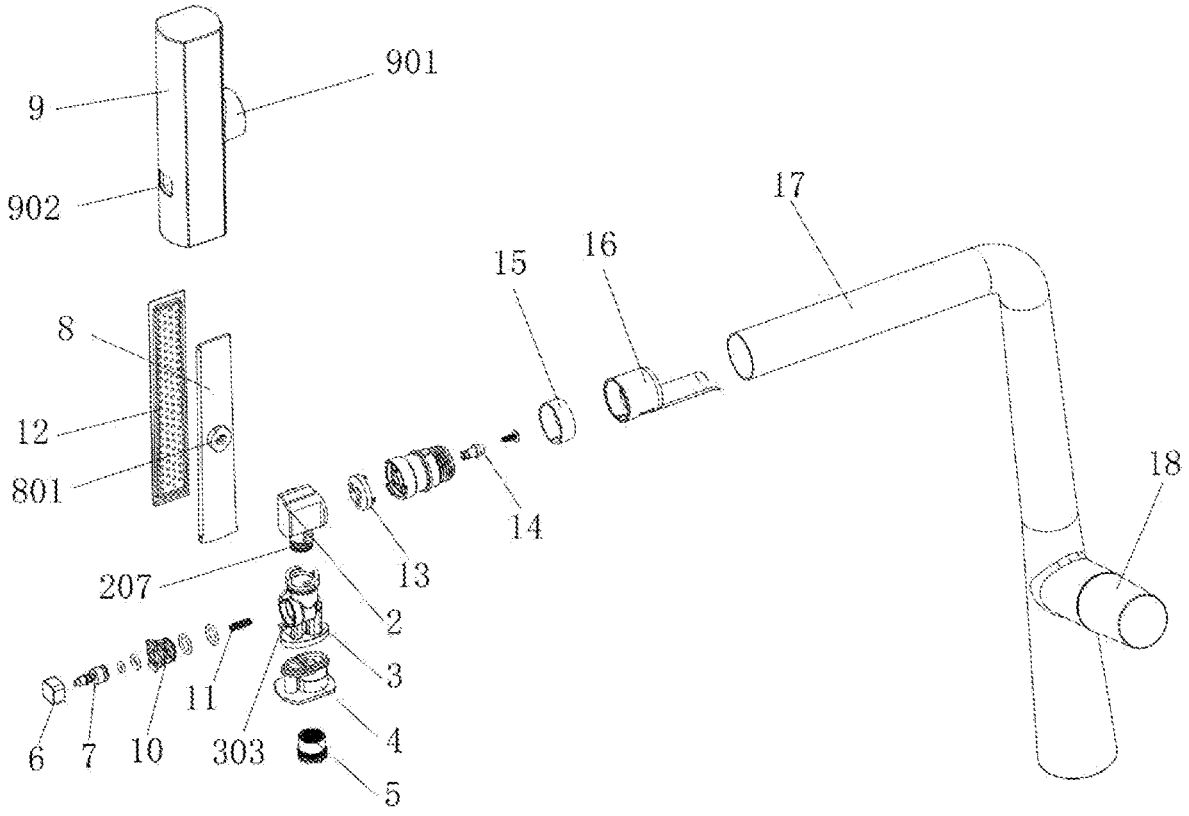
FIG. 1 is an assembly structure diagram of the disclosure.
Figure 2:
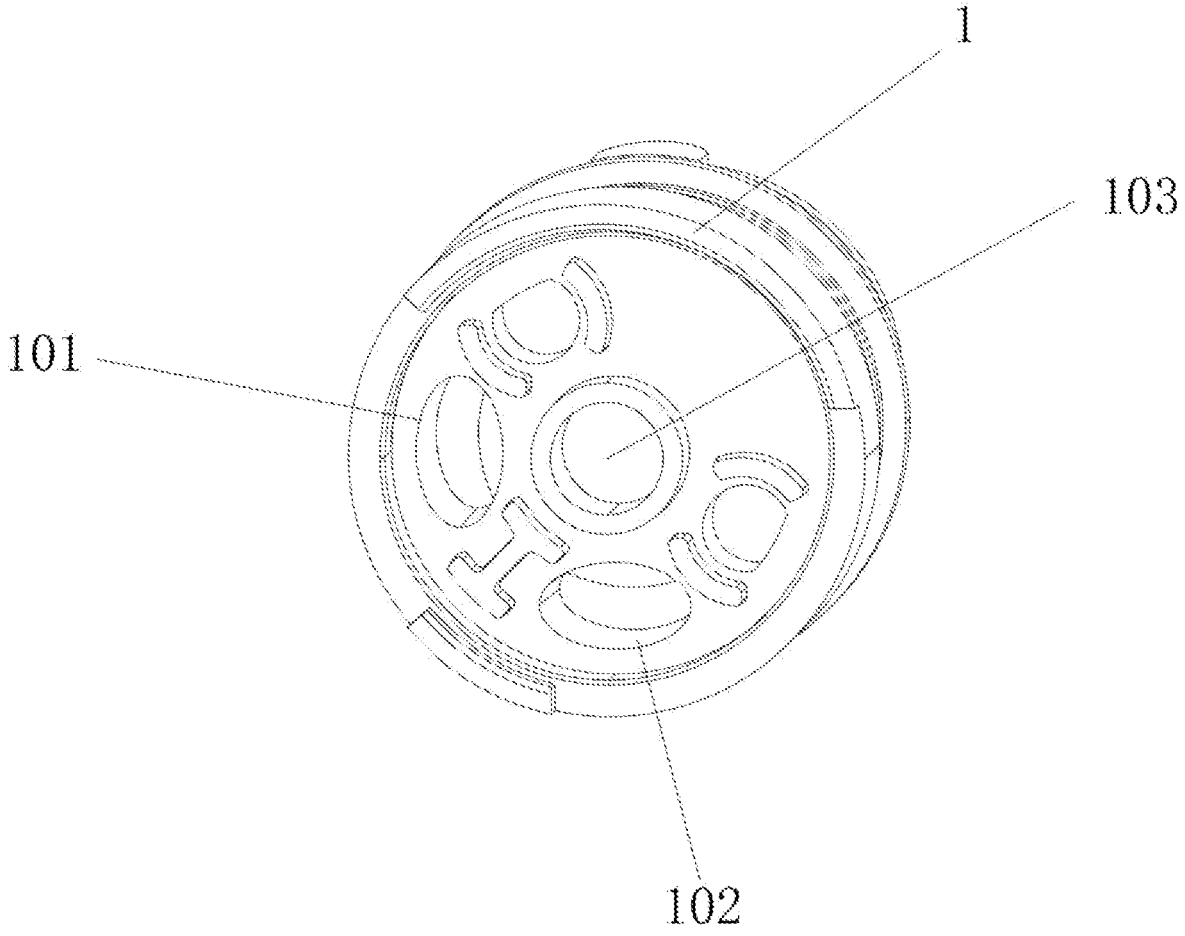
FIG. 2 is a structural schematic diagram of a water diversion seat.
Figure 3:
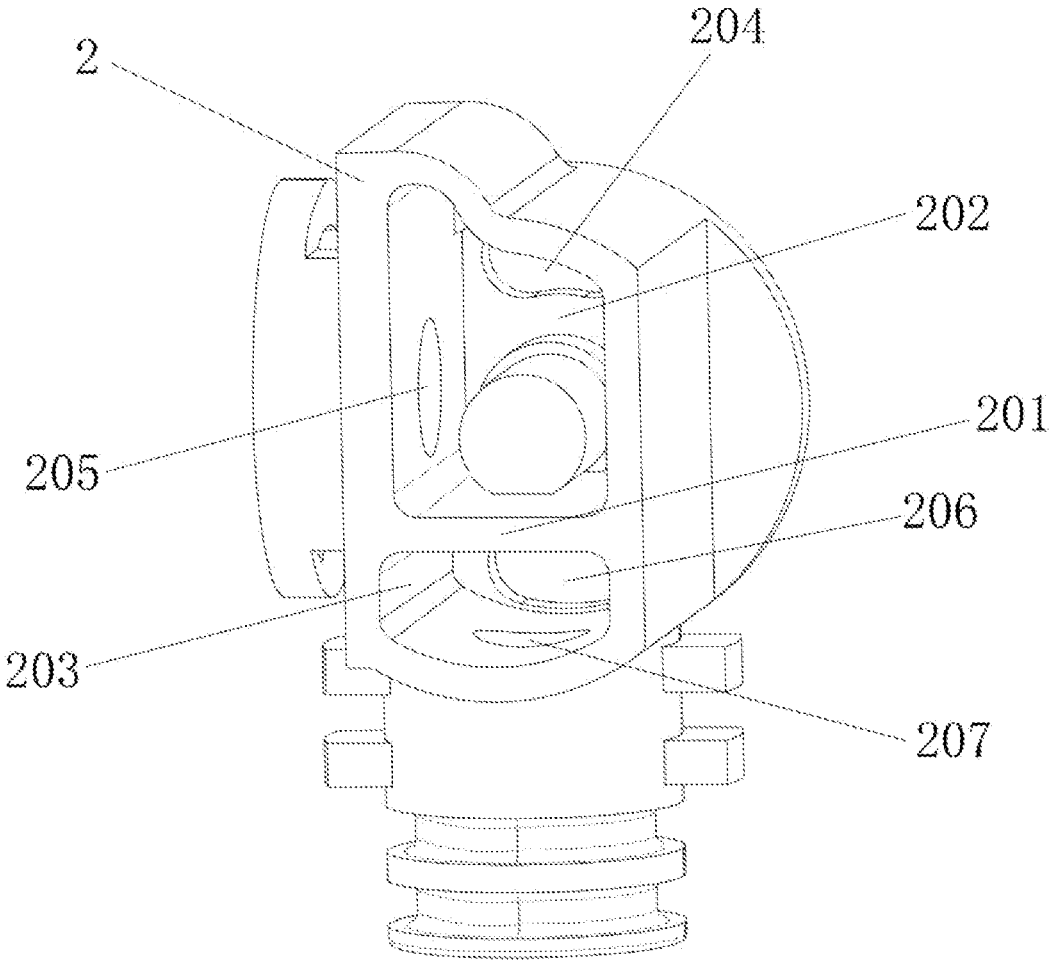
FIG. 3 is an internal structure diagram of a water diversion connector.
Figure 4:
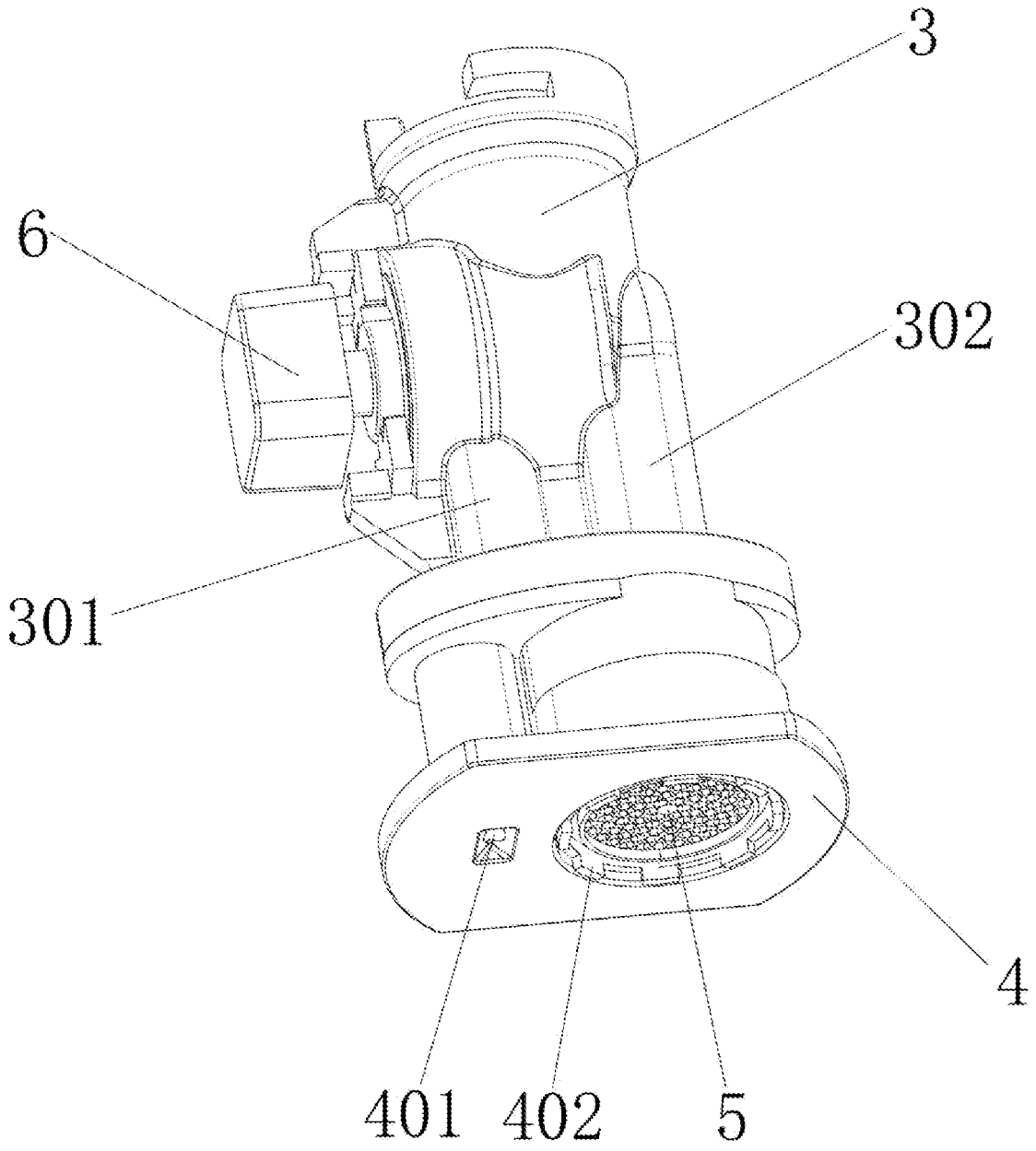
FIG. 4 is a structure diagram of the valve seat and the water outlet in connection.

As shown in FIG. 1 to FIG. 4, a faucet structure is disclosed, the faucet structure comprises a water outlet pipe 17, a control switch 18 is arranged on the water outlet pipe 17, and an end of the water outlet pipe 17 is fixedly connected with a water diversion seat 1, and an end of the water diversion seat 1 is rotatably connected to a water diversion connector 2, a side of the water diversion connector 2 is provided with a first water outlet hole 205 and is connected to a shower head assembly through the first water outlet hole 205, and a bottom end of the water diversion connector 2 is provided with a second water outlet 207 and is connected to a valve seat 3 through the second water outlet hole 207, a side of the valve seat 3 is provided with a switch connection hole 303, a bottom end of the valve seat 3 is provided with a first water flowing hole 302 and a second water flowing hole 301, and a switch assembly for switching the water flow between the first water flowing hole 302 and the second water flowing hole 301 is arranged in the switch connection hole 303.

When water is being discharged, the first water outlet hole 205 is used to make the water flow flow out from the shower head assembly, and when the second water outlet hole 207 enters the valve seat 3, the water flow is controlled by the switch assembly to flow out from the first water flowing hole 302 or the second water flowing hole 301, thereby realizing three different water outflow modes. At the same time, water diversion holes on the water diversion seat 1 and water outlet holes on the water diversion connector 2 are staggerly disposed, the switch of the water outlet between the first water outlet hole 205 and the second water hole 207 can be realized through the rotation of the water diversion connector 2, the operation is more convenient, and the use effect of the disclosure is further improved.

The central position of the water diversion seat 1 is provided with an installation hole 103, and the installation hole 103 is provided with a rotating shaft 14 and is rotatably connected to the central position of the water diversion connector 2 through the rotating shaft 14, a first water diversion hole 101 and a second water diversion hole 102 are eccentrically provided in the water diversion seat 1, and the first water diversion hole 101 and the second water diversion hole 102 communicate with the water outlet pipe 17 internally, a partition plate 201 partitioning the interior of the water diversion connector 2 into a first water outlet cavity 202 and a second water outlet cavity 203 is provided in the water diversion connector 2. A side of the first water outlet cavity 202 close to the water diversion seat 1 is provided with a first water passing hole 204, a side wall of the first water outlet cavity 202 is provided with the first water outlet hole 205, a side of the second water outlet cavity 203 close to the water diversion seat 1 is provided with a second water passing hole 206, and an end wall of a bottom end of the second water outlet cavity 203 is provided with the second water outlet hole 207, when the water diversion connector 2 is rotated and the second water outlet hole 207 faces downward, the second water passing hole 206 is aligned to the second water diversion hole 102, and the first water passing hole 204 is staggered with the first water diversion hole 101; when the water diversion connector 2 is rotated and the first water outlet hole 205 faces downward, the first water passing hole 204 is aligned to the first water diversion hole 101, and the second water passing hole 206 is staggered with the second water diversion hole 102.

The inner side of one end of the water outlet pipe 17 close to the water diversion seat 1 is embedded with a position-limiting sleeve 16, and the position-limiting sleeve 16 is threadedly connected with an end of the water diversion seat 1 close to the water outlet pipe 1, and a flat gasket 13 is provided between the water diversion seat 1 and the water diversion connector 2 and the flat gasket 13 is clamped with and connected to the water diversion seat 1.

By providing the first water outlet cavity, the second water outlet cavity in the water diversion connecter and setting the first water diversion hole and the second water diversion hole in the water diversion seat, water outflow channel can be switched by rotating the water diversion connecter by 90 degrees; when the second water outlet hole faces downward, the second water passing hole is aligned to the second water diversion hole, the first water passing hole and the first water diversion hole are staggerly disposed, and the water flow in the water outlet pipe enters the valve seat after flowing through the second water passing hole and the second water outlet hole and finally flows out from the first water flowing hole or the second water flowing hole; when the first water outlet hole faces downward, the first water passing hole is aligned to the first water diversion hole, the second water passing hole and the second water diversion hole are staggerly disposed, and the water flow in the water outlet pipe enters the shower head assembly after flowing through the first water passing hole and the first water outlet hole to realize the outflow of the water flow from the shower head; in other words, when it is required to discharge water from the shower head, it only needs to rotate the shower head assembly to the lower end, and when it is required to discharge water directly or discharge water from the faucet bubbler, it only needs to rotate the valve seat to the lower end and control the switch assembly to switch the water outflow mode as needed.

The shower head assembly comprises a water outlet housing 8 and a water outlet panel 12. The water outlet housing 8 and the water outlet panel 12 are fixedly connected to form a rectangular hollow shell structure. A middle part of the water outlet housing 8 is provided with a through hole 801 and is connected to the first water outlet hole 205 through the through hole 801. The water outlet panel 12 is provided with several shower spray holes. The water flow enters the water outlet housing 8 from the first water outlet hole 205, and finally sprays out from the shower spray holes on the water outlet panel 12.

The switch assembly comprises a button 6, a valve stem 7, a water control member 10 and a spring 11. One end of the spring 11 urges against the inner wall of the valve seat 3 and the other end of the spring 11 is connected with the water control member 10. The water control member 10 is located in the valve seat 3 and can slide above the first water flowing hole 302 and the second water flowing hole 301 along the axis direction of a switch connection hole 303. The valve stem 7 is located in the switch connection hole 303, one end of the valve stem 7 is connected to the water control member 10 and the other end of the valve stem 7 passes through the switch connection hole 303 and connects with the button 6.

A bottom end of the valve seat 3 is fixedly connected with a water outlet part 4, the water outlet part 4 is provided with a first water outlet channel 402 and a second water outlet channel 401, a top end of the water outlet part 4 is embedded in and connected with the bottom end of the valve seat 3, and a top end of the first water outlet channel 402 communicates with the first water flowing hole 302, a top end of the second water outlet channel 401 communicates with the second water flowing hole 301, and the first water outlet channel 402 is internally connected with a faucet bubbler 5.

For switching the water flow, it only needs to press the button 6 to drive the valve stem 7 to push the water control member 10 to move. The movement of the water control member 10 will block one of the first water flowing hole 302 and the second water flowing hole 301, and the water flow can flow out from the other. The position of the water control member 10 can be switched by pressing the button 6; the button is a common switch structure on the market, and other switches in the prior art can also be used in the present technical solution and achieve the technical effect of the present technical scheme.

The faucet structure also comprises a protective shell 9, the protective shell 9 is fixedly sleeved on the periphery of the water diversion connector 2, the shower head assembly, the switch assembly and the water outlet part 4. The protective shell 9 is arranged in the shape of a rectangular column shell. One end of the protective shell 9 is provided with a first connection port 901, and the first connection port 901 is sleeved on the periphery of the water diversion seat 1, and a wear-resistant ring 15 is arranged between the first connection port 901 and the water diversion seat 1, and the wear-resistant ring 15 is sleeved on the periphery of the water diversion seat 1, a side of the protective shell 9 is provided with a second connection port and is connected to the water outlet panel 12 through the second connection port. A bottom end of the protective shell 9 is provided with a third connection port and is connected to the water outlet part 4 through the third connection port, and another side of the protective shell 9 is provided with an avoidance hole 902 for avoiding the button 6.

The protective shell 9 can provide installation space and protection for the water diversion connector 2, the switch assembly and the water outlet part 4. When rotating the water diversion connector 2, it only needs to rotate the protective shell 9. A fixed connection structure is adopted between the water diversion seat 1 and the water outlet pipe 17. When the water diversion connector 2 is driven to rotate by the protective shell 9, a relative rotation between the water diversion connector 2 and the water diversion seat 1 occurs, so that the water outflow channel of the water flow changes, realizing the switching of the water flow between the first water outlet hole 205 and the second water outlet hole 207; the overall structure is simple and easy to assemble, which further improves the use effect of the disclosure.

When in use, the water flow firstly flows out of the water outlet pipe by operating the control switch, the water flow flows to the valve seat after passing through the water diversion seat and the second water outlet hole of the water diversion connector, and then under the control of the switch assembly, flows out from the first water flowing hole and the second water flowing hole. Since a faucet bubbler is disposed below the first water flowing hole, the water flow below the first water flowing hole flows out from the faucet bubbler, and the water flow below the second water flowing hole flows out directly; when the water flow needs to be discharged from the shower head, rotating the water diversion connector to make the shower head assembly faces downward, at the moment, the water flow from the water outlet pipe flows into the shower head assembly after flowing through the first water outlet hole, and finally flows out from the shower head; only one water outlet pipeline can realize three water outflow modes, that is flowing out directly, flowing out from the shower head and flowing out from the faucet bubbler, the structure is simpler and the production cost is reduced, meanwhile for the three water outflow modes, the water flow always flows out to the same position, movement of the user's use position according to different water outflow modes is not needed, thus the use effect of the faucet is effectively improved.

What is claimed is:

1. A faucet structure comprising a water outlet pipe, and the water outlet pipe is provided with a control switch, wherein an end of the water outlet pipe is fixedly connected to a water diversion seat, and an end of the water diversion seat is rotatably connected to a water diversion connector, a side of the water diversion connector is provided with a first water outlet hole and is connected to a shower head assembly through the first water outlet hole, a bottom end of the water diversion connector is provided with a second water outlet hole and is connected to a valve seat through the second water outlet hole, a side wall of the valve seat is provided with a switch connection hole, a bottom end of the valve seat is provided with a first water flowing hole and a second water flowing hole, a switch assembly for switching a water flow between the first water flowing hole and the second water flowing hole is provided in the switch connection hole;

a central position of the water diversion seat is provided with an installation hole, and the installation hole is provided with a rotating shaft and is rotatably connected to a central position of the water diversion connector through the rotating shaft, a first water diversion hole and a second water diversion hole are eccentrically provided in the water diversion seat, and the first water diversion hole and the second water diversion hole are communicated with the water outlet pipe internally, a partition plate partitioning an interior of the water diversion connector into a first water outlet cavity and a second water outlet cavity is provided in the water diversion connector, a side of the first water outlet cavity close to the water diversion seat is provided with a first water passing hole, and a side wall of the first water outlet cavity is provided with the first water outlet hole, a side of the second water outlet cavity close to the water diversion seat is provided with the second water passing hole, an end wall of a bottom end of the second water outlet cavity is provided with the second water outlet hole, when the water diversion connector is rotated and the second water outlet hole faces downward, the second water passing hole is aligned to the second water diversion hole, and the first water passing hole is staggered with the first water diversion hole, when the water diversion connector is rotated and the first water outlet hole faces downward, the first water passing hole is aligned to the first water diversion hole, and the second water passing hole is staggered with the second water diversion hole.

2. The faucet structure according to claim 1, wherein an inner side of an end of the water outlet pipe close to the water diversion seat is embedded with a position-limiting sleeve and the position-limiting sleeve is threadedly connected with an end of the water diversion seat close to the water outlet pipe, and a flat gasket is provided between the water diversion seat and the water diversion connector and the flat gasket is clamped with and connected to the water diversion seat.

3. The faucet structure according to claim 2, wherein the shower head assembly comprises a water outlet housing and a water outlet panel, the water outlet housing and the water outlet panel are fixedly connected to form a rectangular hollow shell structure, a middle part of the water outlet housing is provided with a through hole and is connected to the first water outlet hole through the through hole, the water outlet panel is provided with several shower spray holes.

4. The faucet structure according to claim 3, wherein the switch assembly comprises a button, a valve stem, a water control member and a spring, an end of the spring urges against an inner wall of the valve seat and another other end of the spring is connected with the water control member, the water control member is located in the valve seat and can slide above the first water flowing hole and the second water flowing hole along an axis direction of the switch connection hole, the valve stem is located in the switch connection hole, an end of the valve stem is connected to the water control hole and another end of the valve stem passes through the switch connection hole and connects with the button.

5. The faucet structure according to claim 4, wherein the bottom end of the valve seat is fixedly connected with a water outlet part, the water outlet part is provided with a first water outlet channel and a second water outlet channel, a top end of the water outlet part is embedded in and connected with the bottom end of the valve seat, and a top end of the first water outlet channel communicates with the first water flowing hole, a top end of the second water outlet channel communicates with the second water flowing hole, and the first water outlet channel is internally connected with a faucet bubbler.

6. The faucet structure according to claim 5 further comprises a protective shell, the protective shell is fixedly sleeved on the periphery of the water diversion connector, the shower head assembly, the switch assembly and the water outlet part, the protective shell is arranged in the shape of a rectangular column shell and an end of the protective shell is provided with a first connection port and the first connection port is sleeved on the periphery of the water diversion seat, and a wear-resistant ring is arranged between the first connection port and the water diversion seat, the wear-resistant ring is sleeved on the periphery of the water diversion seat, a side of the protective shell is provided with a second connection port and is connected to the water outlet panel through the second connection port, a bottom end of the protective shell is provided with a third connection port and is connected to the water outlet part through the third connection port, and another side of the protective shell is provided with an avoidance hole for avoiding the button.

* * * * *